US006295968B2

(12) United States Patent
Torii et al.

(10) Patent No.: US 6,295,968 B2
(45) Date of Patent: Oct. 2, 2001

(54) THROTTLE APPARATUS FOR INTERNAL COMBUSTION ENGINE

(75) Inventors: Katsuya Torii; Yuichiro Miura, both of Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/779,741

(22) Filed: Feb. 9, 2001

(30) Foreign Application Priority Data

Feb. 17, 2000 (JP) ..... 12-039709
Jan. 17, 2001 (JP) ..... 13-009000

(51) Int. Cl.[7] ..... F02D 31/00; F02D 9/02
(52) U.S. Cl. ..... 123/399; 123/337
(58) Field of Search ..... 123/399, 400, 123/337, 361; 251/305

(56) References Cited

U.S. PATENT DOCUMENTS 5,490,487 * 2/1996 Kato et al. ..... 123/339
5,664,542 * 9/1997 Kanazawa et al. ..... 123/361
5,868,114 * 2/1999 Kamimura et al. ..... 123/399
5,979,405 * 11/1999 Sato et al. ..... 123/399
6,067,958 * 5/2000 Kamimura et al. ..... 123/337
6,098,594 * 8/2000 Kowatari et al. ..... 123/399
6,109,240 * 8/2000 Sato et al. ..... 123/399
6,155,533 * 12/2000 Semeyn et al. ..... 251/129.12
6,170,461 * 1/2001 Pursifull ..... 123/337
6,240,899 * 6/2001 Yamada et al. ..... 123/396

FOREIGN PATENT DOCUMENTS 10-47520 2/1998 (JP) .
11-62637 3/1999 (JP) .
11-132062 5/1999 (JP) .
265861 * 9/2000 (JP) ..... F02D/9/10

* cited by examiner

*Primary Examiner*—Tony M. Argenbright
*Assistant Examiner*—Hai Huynh
(74) *Attorney, Agent, or Firm*—Nixon & Vanderhye P.C.

(57) ABSTRACT

A metal plate is made of a material having strength higher than a resin material for forming a throttle body and is disposed in the throttle body. The plate supports one end of a throttle shaft, fixes a shaft, and holds a motor. When the throttle body is made of a resin material, therefore, the rigidity of the throttle apparatus is enhanced and high dimensional accuracy among the throttle shaft, the shaft, and a rotary shaft can be assured.

13 Claims, 8 Drawing Sheets

THROTTLE APPARATUS FOR INTERNAL COMBUSTION ENGINE

CROSS-REFERENCE TO RELATED APPLICATION

The present invention is related to Japanese patent application No. 2000-39709, filed Feb. 17, 2000; 2001-9000, filed Jan. 17, 2001, the contents of which are incorporated herein by reference.

FIELD OF THE INVENTION

The present invention relates to a throttle apparatus for an internal combustion engine, and more particularly to a throttle apparatus for an internal combustion engine for adjusting an air flow rate of the engine.

BACKGROUND OF THE INVENTION

In a conventional throttle apparatus, an air path is formed in a throttle body and a valve member adjusts the opening angle of the air path. The valve is driven by electric driving means, such as a motor, such that even when the motor stops due to a breakdown or the like, the valve member is set to a desired open position, such as slightly open to maintain an opening angle in the air path. For example, by providing a return spring that urges the valve member closed, the valve member is set slightly open, even when the motor is unable to drive the valve member. Thus, the valve member is set slightly open, thereby enabling evacuation drive of a vehicle on which the throttle device is mounted.

In the conventional throttle apparatus, the throttle body and a gear housing of the motor are made of a metal material such as aluminum, manufactured with high precision. The rotary shaft of speed reducing gears such as the throttle gear and motor gear are supported by the gear housing.

In recent years, however, because of a demand for reduction in weight and cost of throttle devices, the throttle body is molded from a resin. When the throttle body is made of resin, the gear housing is also made of resin. Accordingly, the gear housing and the throttle body are integrally formed. However, when this is done, the molding may distort in the throttle body and dimensional accuracy between rotary shafts of speed reducing gears largely deteriorates due to insufficient rigidity of the throttle body as compared with one made of metal.

When the dimensional accuracy between the rotary shafts of the speed reducing gears deteriorates, the gear teeth of the gears wear during use, thereby causing motor torque loss. Moreover, it becomes difficult to transmit the motor driving force to the valve member. Further, when the dimensional accuracy between the rotary shafts of the speed reducing gears largely deteriorates, the speed reducing gears are locked and the valve member cannot be driven.

SUMMARY OF THE INVENTION

In view of these and other drawbacks, the present invention provides a throttle apparatus for an engine, having lower weight and cost, and assures high dimensional accuracy by enhancing rigidity.

According to the present invention, a holding member is provided in the throttle body that is made of a material having a higher strength than the resin material used for forming the throttle body. The holding member rotatably supports the valve member and holds the electric driving means. By making the throttle body from a resin material and housing the electric driving means in the throttle body, reduction in weight and cost of the throttle apparatus can be achieved. Further, with the holding member made of a high strength material, the rigidity of the throttle apparatus is enhanced and durability is improved. Further, since the holding member supports the valve member and holds the electric driving means, even when the throttle body is made of a resin material, high dimensional accuracy is assured between the supported portion of the valve member and the driving portion of the electric driving means. Therefore, the driving force of the electric driving means is transmitted to the valve member, and the controllability of the valve member is improved. Therefore, the air flow rate of the air path is properly adjusted.

In another aspect of the invention, a supporting member rotatably supports a transmitting means and is fixed to the holding member. The transmitting means is connected to the electric driving means and transmits a driving force from the electric driving means to the valve member. Consequently, high dimensional accuracy between the supporting member and the supported portion in the valve member and high dimensional accuracy between the supporting member and the driving portion in the electric driving means is assured. Therefore, the driving force of the electric driving means is more effectively transmitted to the valve member and the controllability of the valve member is increased. Accordingly, the air flow rate in the air path is more effectively adjusted.

In another aspect of the invention, the holding member houses the electric driving means. The holding member also serves as the housing of the electric driving means, thereby reducing the number of parts and assembly steps.

In another aspect of the invention, an inner wall of the air path near the valve member is formed by the holding member, so that the supported portion in the valve member and the driving portion of the electric driving means is parallel and held with high accuracy. Consequently, the driving force of the electric driving means is reliably transmitted to the valve member and the valve member is effectively controlled. Further, by integrating the portion where the air path inner wall near the valve member of the holding member is formed and the portion for holding the electric driving means, manufacturing cost is reduced without increasing the number of parts and assembling steps.

In another aspect of the invention, the holding member provided in the resin throttle body is made of a material having strength higher than the resin material of the throttle body. The holding member fixes the supporting member for rotatably supporting the transmitting means for transmitting the driving force of the electric driving means to the valve member. The holding member also and holds the electric driving means.

In another aspect of the invention, the holding member houses the electric driving means. The holding member also serves as the housing of the electric driving means, thereby reducing the number of parts and assembly steps.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE INVENTION

Figure 1:
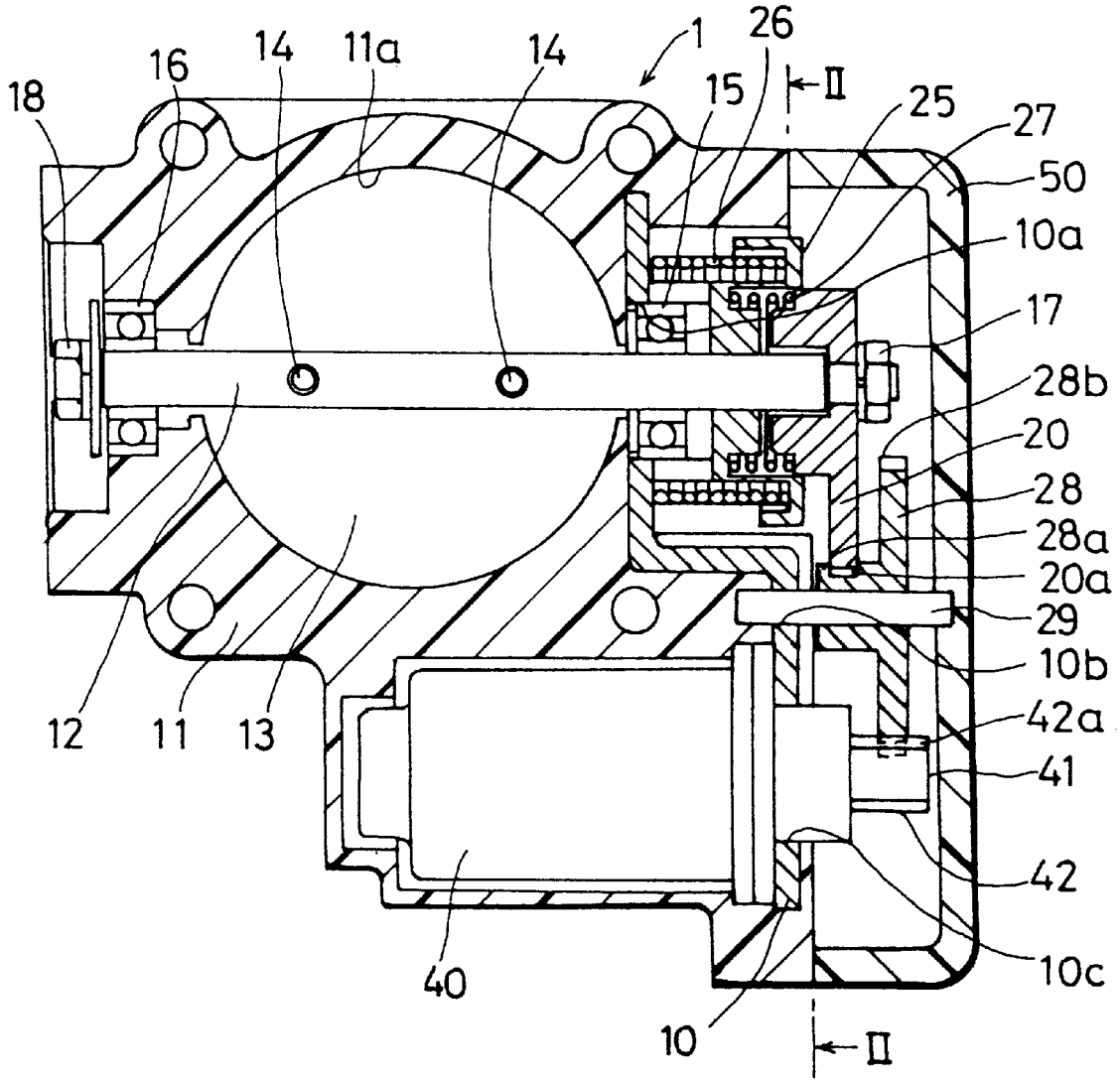
FIG. 1 is a cross sectional view of a throttle apparatus for an engine according to a first embodiment of the present invention.
Figure 2:
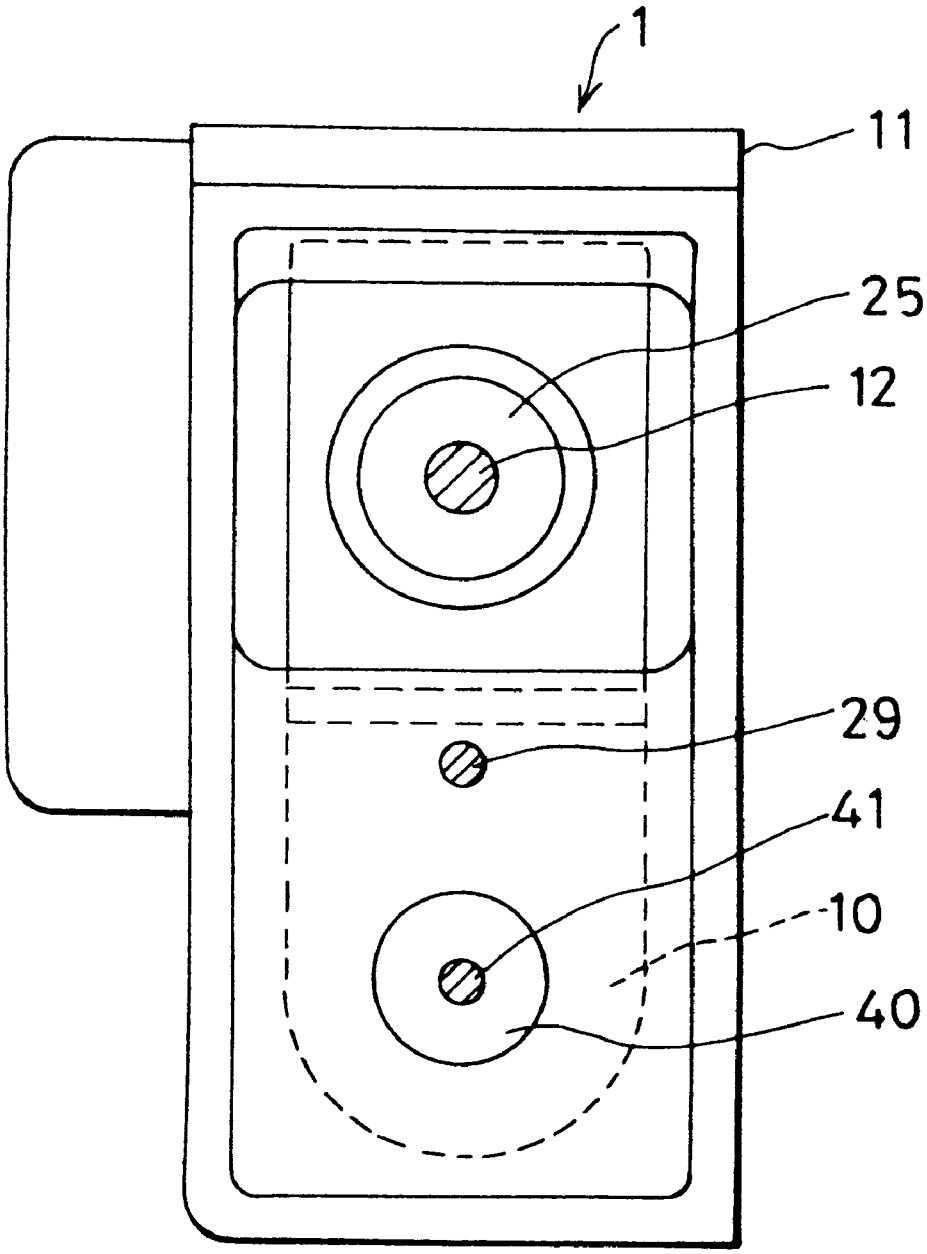
FIG. 2 is a cross sectional view taken along line II—II of FIG. 1.

FIGS. 1 and 2 show a throttle apparatus for an engine according to a first embodiment of the invention. Here, a throttle apparatus 1 (shown in FIG. 1) electrically controls the throttle opening angle according to engine operating conditions such as accelerator position, engine speed, engine load, and water temperature to thereby adjust the flow rate of intake air flowing through an intake path 11*a* formed in a throttle body 11 made of a resin. The state shown in FIG. 1 is a full close state of the throttle apparatus 1.

A throttle shaft 12 is rotatably supported by the inner wall of a supporting hole 10*a* of a metal plate 10 (which will be described herein later) via bearing 15 provided at one end of the throttle shaft 12. Throttle shaft 12 is rotatably supported by the throttle body 11 via a bearing 16 provided at an opposite end of the throttle shaft 12. A throttle valve 13 is disc shaped and fixed to the throttle shaft 12 via screws 14. Throttle shaft 12 and throttle valve 13 swing integrally.

A throttle gear 20 is semi-circular plate shaped and is non-rotatably fixed to the throttle shaft 12 by a bolt 17. The throttle gear 20 has gear teeth 20*a* which engage with small-diameter gear teeth 28*a* of an intermediate gear 28. As shown in FIG. 2, retaining member 25 is circular shaped and the throttle shaft 12 is fit in the retaining member 25 between the throttle gear 20 and the bearing 15. The retaining member 25 is fixed to the throttle gear 20 by the spring 27 so that the retaining member 25 stops approximately at a slightly open position (an intermediate opening position) from the full closed position while the throttle 13 moves from a valve-open position to a valve-closed position. The retaining member is stopped by an intermediate stopper (not shown).

The spring 27 does not urge the throttle shaft 12 when the spring 27 is positioned at the intermediate opening position. However, when a driving force in the closing direction is further applied to the throttle gear 20 from the intermediate opening position, the throttle gear 20 rotates in the closing direction against the urging force of the spring 27 to move the throttle valve 13 into a full closed position. Further, the spring 26 is fixed between the retaining member 25 and the metal plate 10. The spring 26 is fixed to integrally urge the retaining member 25, the spring 27 and the throttle gear 20 in the valve closing direction only when the throttle 13 opens more than the intermediate position.

The intermediate gear 28 as a transmitting means has small-diameter gear teeth 28*a* and large-diameter gear teeth 28*b* and is rotatably supported by a shaft 29. The small-diameter gear teeth 28*a* engage the gear teeth 20*a* of the throttle gear 20, and the large diameter gear teeth 28*b* engage gear teeth 42*a* of motor gear 42 of motor 40. The shaft 29, a supporting member, is fixed to the inner wall of a fixing hole 10*b* of the metal plate 10 by press-fitting, adhesion, welding, or the like.

The motor 40, an electric driving means, can be a DC motor, housed in the throttle body 11, and attached to and held by the inner wall of a holding hole 10*c* of the metal plate 10. Gear teeth 42*a* of the motor gear 42 which rotates with a rotary shaft 41 of the motor 40 engage with the large-diameter gear teeth 28*b* of the intermediate gear 28. By rotation of motor 40, motor 40 driving force is applied to the throttle shaft 12 and the throttle valve 13 via the intermediate gear 28 and the throttle gear 20. This, thereby adjusts the throttle opening angle. A cover 50 made of resin is joined to the throttle body 11 by welding or the like and covers the throttle gear 20, intermediate gear 28, and motor gear 42.

The metal plate 10, a holding member, provided in the throttle body 11 by insertion molding is made of a material having a higher strength than the resin material. The material can be aluminum for forming the throttle body 11. The plate 10 is plate-shaped and has a bent portion. The metal plate 10 has a supporting hole 10*a*, fixing hole 10*b*, and holding hole 10*c*. One end of the throttle shaft 12 is supported by the inner wall of the supporting hole 10*a* via the bearing 15. The shaft 29 is fixed to the inner wall of the fixing hole 10*b*, and the motor 40 is held on the inner wall of the holding hole 10*c*. By this construction, the rigidity of the throttle apparatus 1 is enhanced and the high dimensional accuracy among throttle shaft 12, shaft 29, and rotary shaft 41 is assured.

A rotation angle sensor (not shown) is attached to the throttle body 11 on a side opposite to throttle gear 20 over the intake path 11*a*. A lever member (not shown) of the rotation angle sensor is fit to a contact member (not shown) fixed to the throttle shaft 12 by a bolt 18. When the lever member of the rotation angle sensor rotates with the contact member, the throttle opening angle is detected. The rotation angle sensor is electrically connected to a not-shown electronic control unit (ECU). The ECU controls the driving current supplied to the motor according to the engine operating conditions to adjust the throttle opening angle.

The operation of the throttle apparatus 1 will now be described. The ECU supplies the driving current to the motor 40 and controls a current value sent to the motor 40 according to the engine operating conditions such as engine speed, engine load, accelerator position, and water temperature and a detection signal of the rotation angle sensor to thereby adjust the throttle opening angle. Between the full closed position and the intermediate opening degree, the throttle gear 20 and the retaining member 25 integrally rotate by the urging force of the spring 27. About where the valve is slightly open, the current value supplied to the motor 40 is raised to increase the driving force in the opening direction applied to the throttle shaft 12. The throttle gear 20 rotates in the opening direction integrally with the retaining member 25 against the urging force of the spring 26. Meanwhile, because of the high dimensional accuracy among the throttle shaft 12, shaft 29, and rotary shaft 41, the motor 40 driving force is effectively transmitted to the throttle valve 13 via rotary shaft 41, gear teeth 42*a*, large-diameter gear teeth 28*b*, small-diameter gear teeth 28*a*, gear teeth 20*a*, and the throttle shaft 12. Consequently, the controllability of the throttle valve 13 is enhanced. The intake air flow rate passing through the intake path 11*a* is therefore effectively adjusted.

Figure 7:
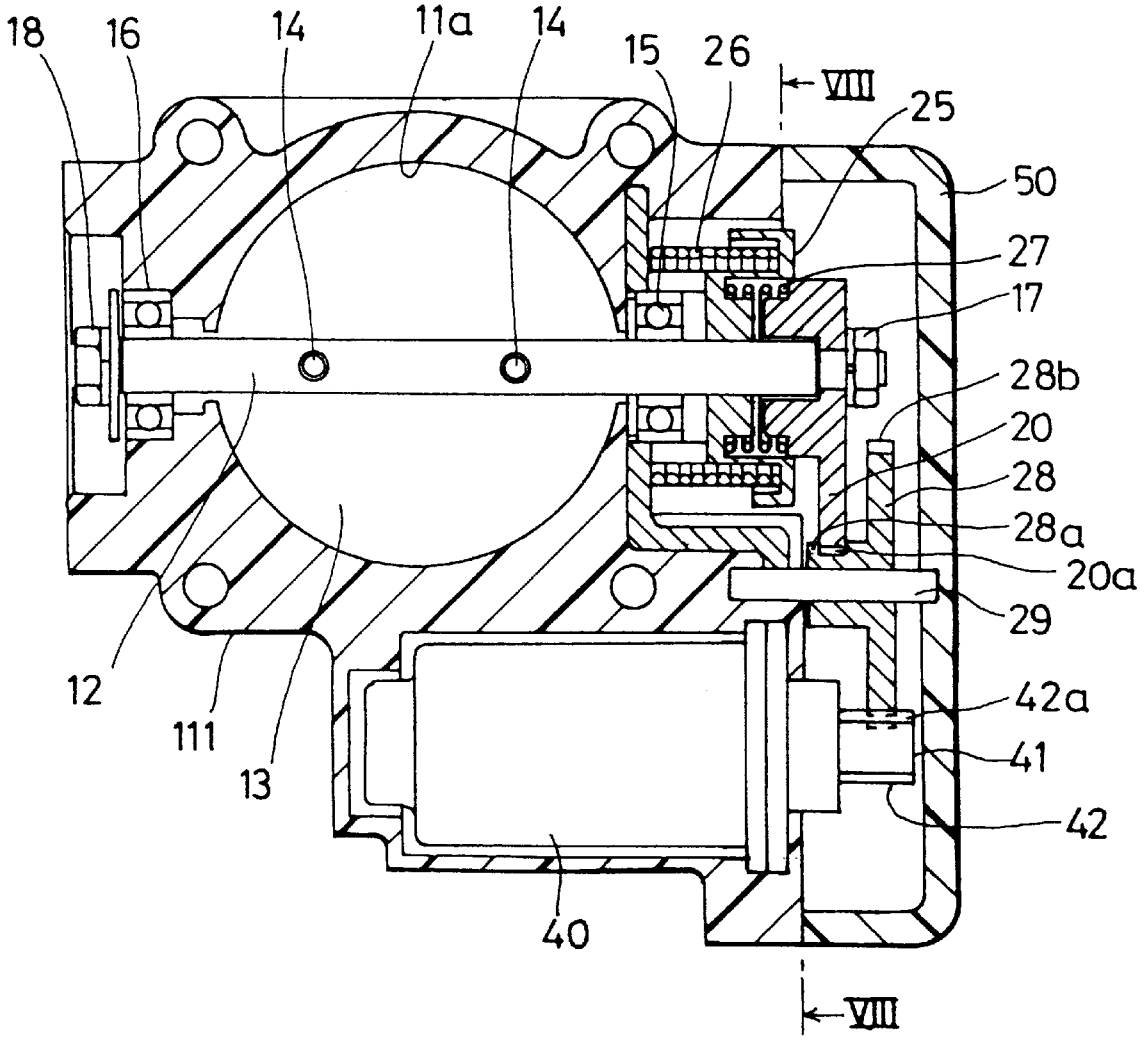
FIG. 7 is a cross sectional view of a throttle apparatus for an engine according to the present invention.
Figure 8:
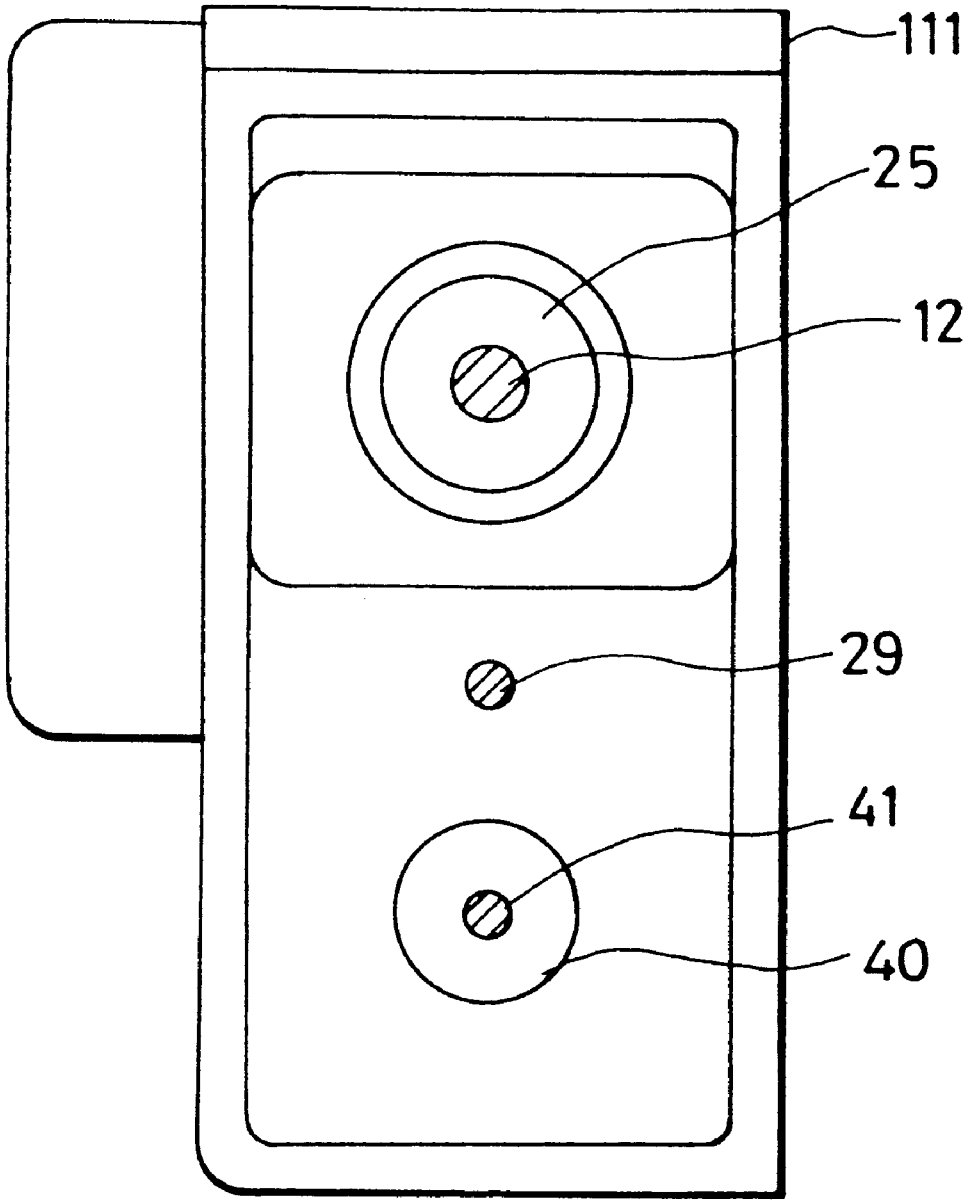
FIG. 8 is a cross sectional view taken along line VIII—VIII of FIG. 7.

An example of the first embodiment that does not use metal plate 10, and has a throttle body made of resin, is described using FIGS. 7 and 8. The same reference numerals are given to the same components as those of the first embodiment shown in FIGS. 1 and 2. As shown in FIGS. 7 and 8, one end of the throttle shaft 12 is rotatably supported by throttle body 111 made of a resin via the bearing 15. Here, the throttle body 111 holds the other end of the spring 26, the shaft 29 and the motor 40.

In this example, the dimensional accuracy between the throttle shaft 12, shaft 29 or the rotary shaft 1 is much lower than in the first embodiment due to insufficient rigidity of the throttle body 111. Consequently, gear teeth 42*a*, large-diameter gear teeth 28*b*, small-diameter gear teeth 28*a*, or gear teeth 20*a* may wear during use. This results in torque loss of motor 40 and transmission loss of driving force of motor 40 to throttle valve 13. Further, when dimensional accuracy between throttle shaft 12 and shaft 29 or rotary shaft 41 largely deteriorates, the gear teeth 42*a*, large-diameter gear teeth 28*b*, small-diameter gear teeth 28*a*, or gear teeth 20*a* lock and the throttle valve 13 cannot be driven.

On the other hand, in the first embodiment, because of the metal plate 10, one end of the throttle shaft 12 is supported, the other end of the spring 26 and the shaft 29 are fixed, and the motor 40 is held. Consequently, even when the throttle body 11 is made of resin material, the rigidity of the throttle apparatus 1 is enhanced, and high dimensional accuracy among the throttle shaft 12, shaft 29, and rotary shaft 41 can be assured. The driving force of the motor 40 can be therefore effectively transmitted to the throttle valve 13 via the rotary shaft 41, gear teeth 42*a*, large diameter gear teeth 28*b*, small-diameter gear teeth 28*a*, gear teeth 20*a*, and throttle shaft 12. By increasing the controllability of the throttle valve 13, the intake air flow rate flowing through the intake path 11*a* can be effectively adjusted.

Further, in the first embodiment, by forming the throttle body 11 of a resin material and enclosing the motor 40 in the throttle body 11, the weight and cost of the throttle apparatus can be reduced. By providing the metal plate 10 made of a material having strength higher than the resin material for forming the throttle body 11, the rigidity of the throttle apparatus 1 is enhanced and durability can be therefore improved.

(Second Embodiment)

Figure 3:
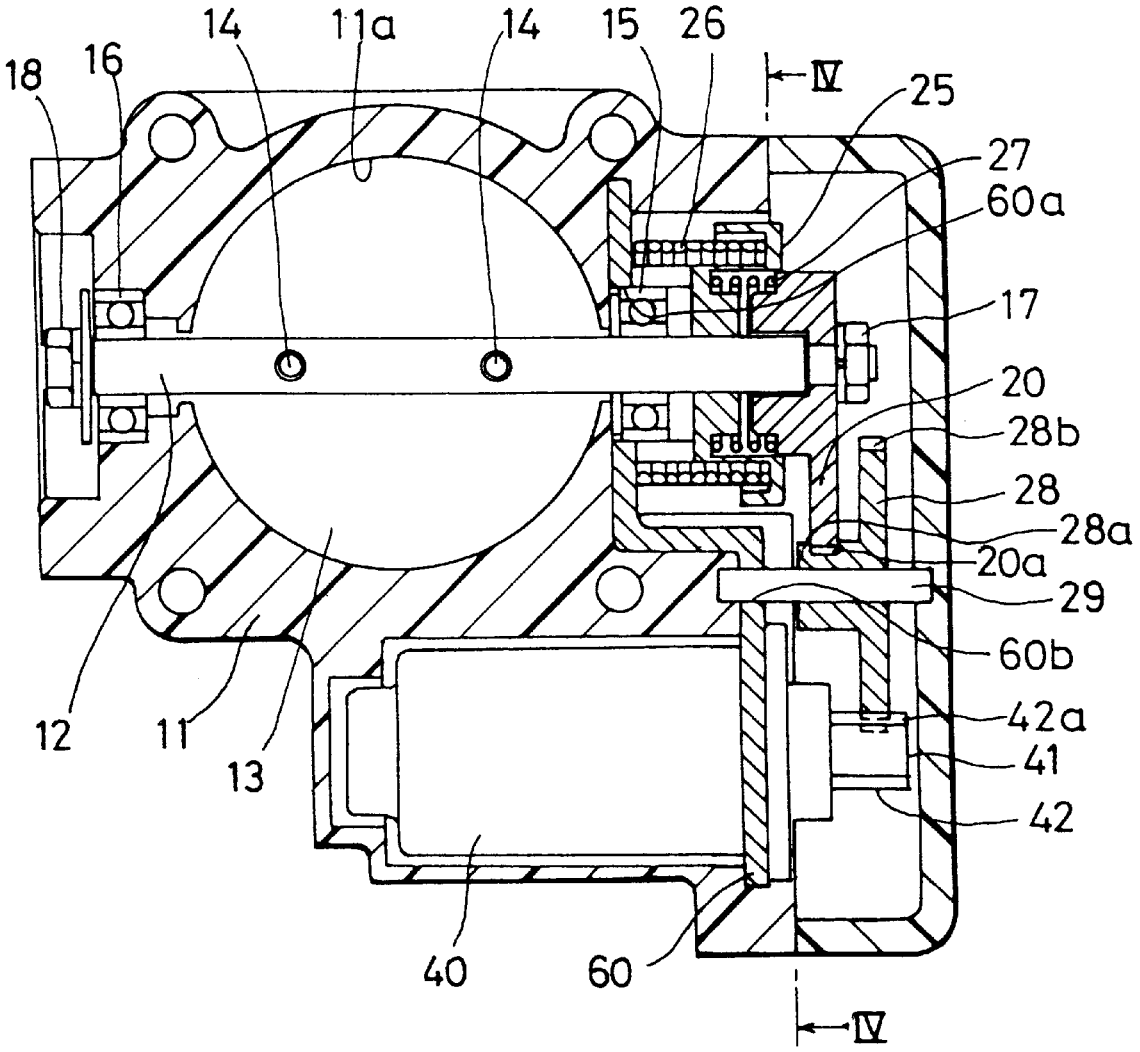
FIG. 3 is a cross sectional view of a throttle apparatus for an engine according to a second embodiment of the present invention.
Figure 4:
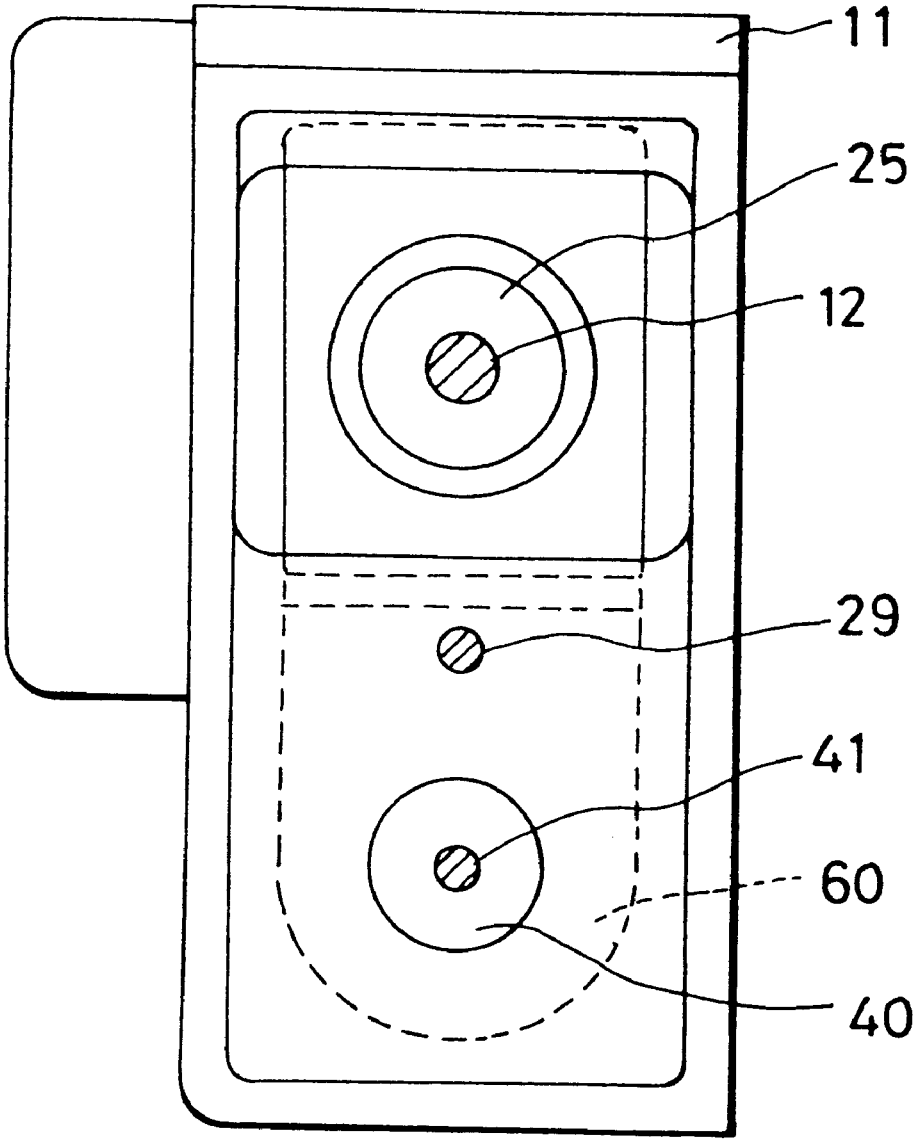
FIG. 4 is a cross sectional view taken along line IV—IV of FIG. 3.

FIGS. 3 and 4 show a second embodiment of the invention. In the second embodiment, the metal plate 10 in the first embodiment shown in FIGS. 1 and 2 also serves as a housing of the motor 40, and the same components as those in the first embodiment are designated by the same reference numerals.

As shown in FIGS. 3 and 4, a metal plate 60, a holding member, is provided by insertion molding in the throttle body 11 and is made of a material having strength higher than the resin material. Such material may be aluminum, and the throttle body is preferably an integral member containing the housing of the motor 40. The metal plate 60 has a supporting hole 60*a* and a fixing hole 60*b*. One end of the throttle shaft 12 is supported by the inner wall of the supporting hole 60*a* via the bearing 15, and the shaft 29 is fixed to the inner wall of the fixing hole 60*b*. The motor 40 is housed and held in the metal plate 60.

In the second embodiment as well, the rigidity of the throttle apparatus is enhanced and high dimensional accuracy among the throttle shaft 12, shaft 29, and rotary shaft 41 is assured. Further, in the second embodiment, the motor 40 is housed in the metal plate 60. Consequently, by allowing the metal plate 60 to serve as the housing of the motor 40, the number of parts is reduced and the number of assembling steps is decreased. Thus, the construction is simplified and the manufacturing cost is reduced.

(Third Embodiment)

Figure 5:
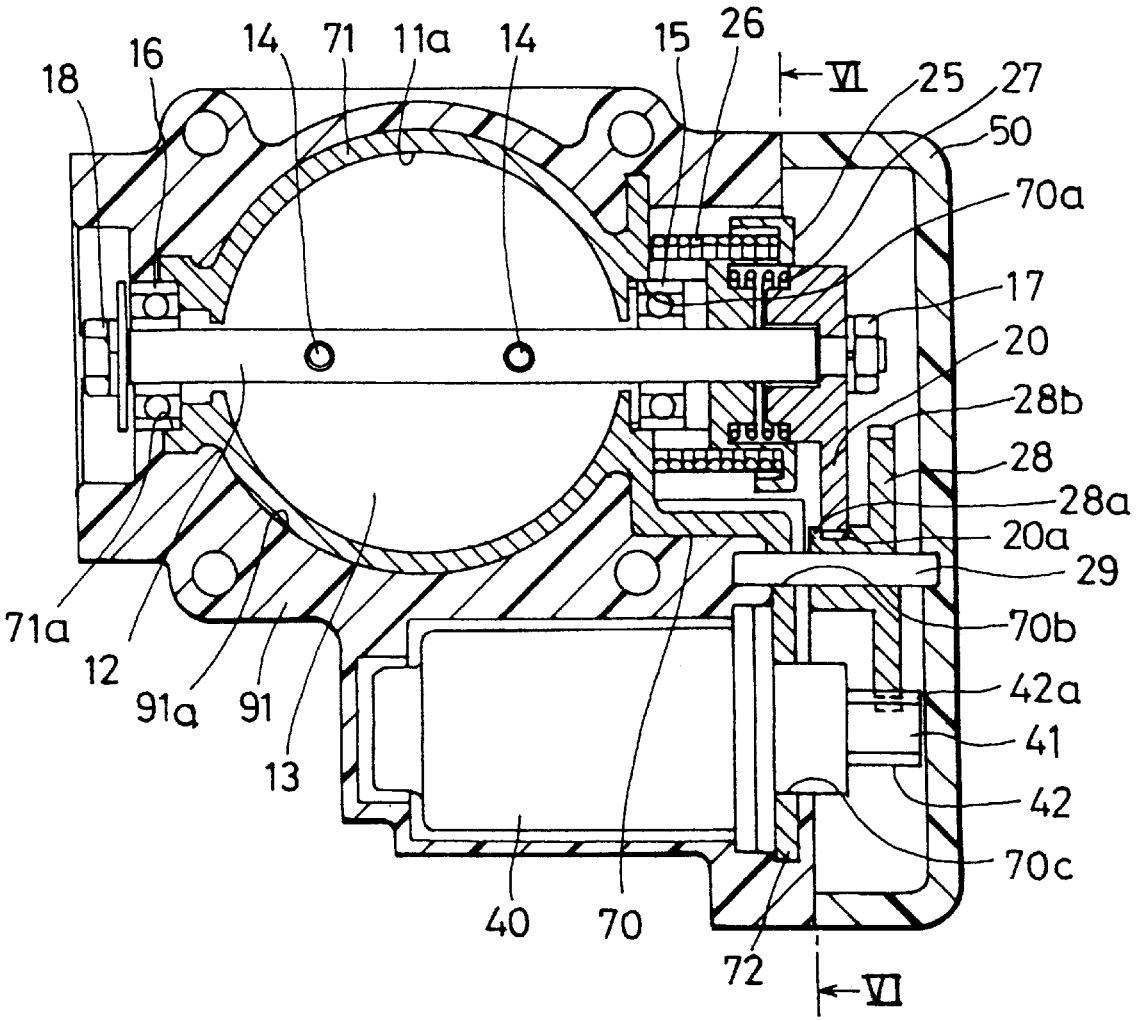
FIG. 5 is a cross sectional view of a throttle apparatus for an engine according to a third embodiment of the present invention.
Figure 6:
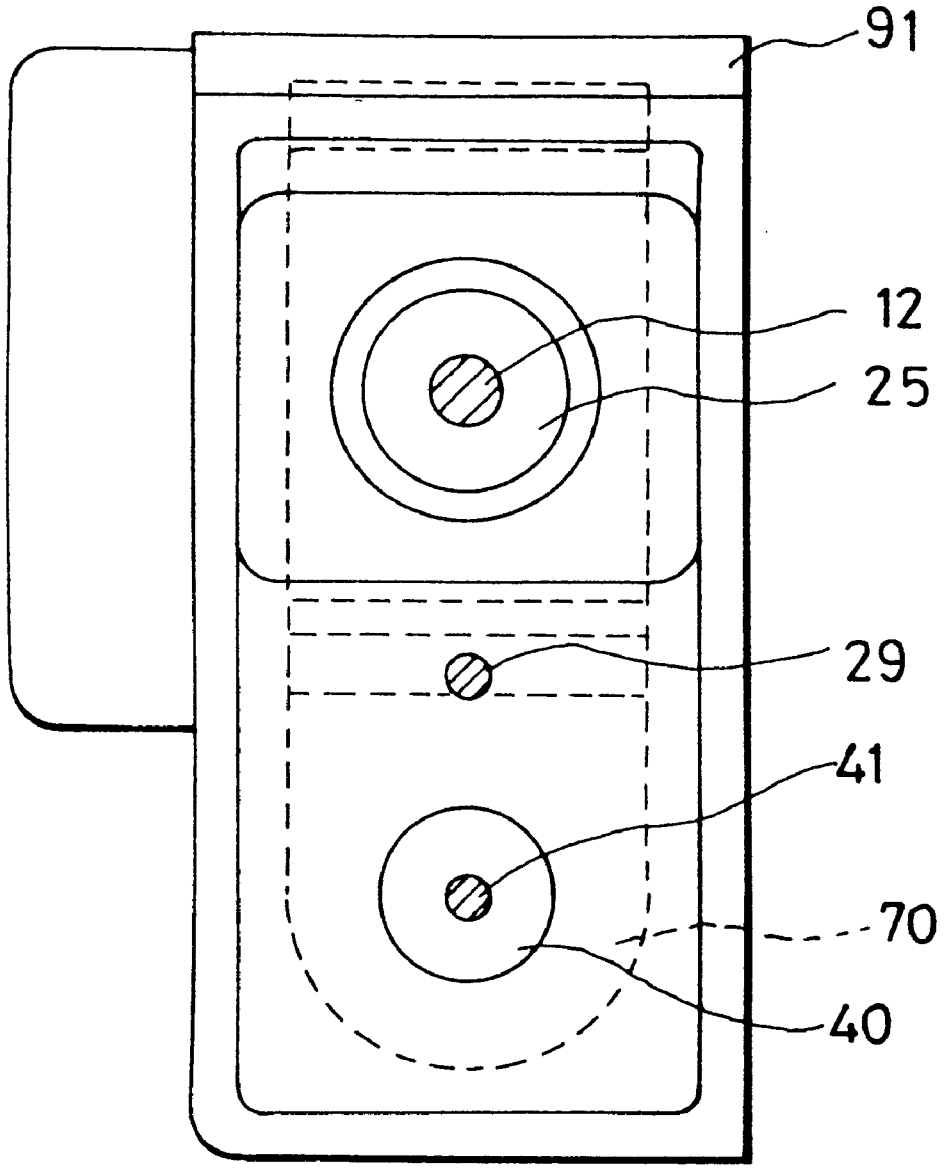
FIG. 6 is a cross sectional view taken along line VI—VI of FIG. 5.

FIGS. 5 and 6 show a third embodiment of the invention. In the second embodiment, the inner wall of the intake path 11*a* near the throttle valve 13 is formed by the metal plate 10 of the first embodiment shown in FIGS. 1 and 2, and the same components as those of the first embodiment are designated by the same reference numerals.

As shown in FIGS. 5 and 6, a metal plate 70 is a holding member provided by insertion molding in throttle body 91 made of a resin. Metal plate 70 is made of a higher strength material than the resin material. Plate 70 can be aluminum, and is an integral member having a ring portion 71 and a plate portion 72. The ring portion 71 is provided on the inner circumference of bore 91*a* of the throttle body 91 and serves as the inner wall of the intake path 11*a* near the throttle valve 13. The ring portion 71 has supporting holes 70*a* and 71*a*. One end of the throttle shaft 12 is supported on the inner wall of the supporting hole 70*a* via the bearing 15, and the other end of the throttle shaft 12 is supported by the inner wall of the supporting hole 71*a* via the bearing 16. The plate portion 72 has a fixing hole 70*b* and a holding hole 70*c*. The shaft 29 is fixed on the inner wall of the fixing hole 70*b*, and the motor 40 is held on the inner wall of the holding hole 70*c*.

In the third embodiment as well, the rigidity of the throttle apparatus is enhanced and high dimensional accuracy among the throttle shaft 12, shaft 29, and rotary shaft 41 is assured.

Further, in the third embodiment, the inner wall of the intake path 11*a* near the throttle valve 13 is formed by the ring portion 71, so that the throttle shaft 12, shaft 29, and rotary shaft 41 are parallel and held with high precision. Therefore, the driving force of the motor 40 is reliably transmitted to the throttle valve 13 and the controllability of the throttle valve 13 is increased. Further, by integrating the ring portion 71 and the plate portion 72, without increasing the number of parts and the number of assembling steps, the manufacturing cost can be reduced while maintaining simple construction.

In the foregoing embodiments, the metal plate is provided by insertion molding in the throttle body. In the invention, part of the metal plate may be exposed to the outside of the throttle body, or the metal plate may be fit to the throttle body. Although a metal plate is used as the holding member in the above embodiments, the plate may be made of resin provided that the resin has a strength higher than the resin material used for forming the throttle body. The plate may also be any suitable hard metal such as magnesium.

While the above-described embodiments refer to examples of usage of the present invention, it is understood that the present invention may be applied to other usage, modifications and variations of the same, and is not limited to the disclosure provided herein.

What is claimed is:

1. A throttle apparatus for adjusting an air flow rate through an air path formed in an internal combustion engine, said throttle apparatus comprising:

a resin throttle body material having an air path formed therein;

a valve member provided in the throttle body that controls an opening angle of the air path;

electric driving device housed in the throttle body, said electric driving device generating a driving force that drives the valve member; and a holding member provided in the throttle body that rotatably supports the valve member, said holding member holding the electric driving device, said holding member being made of a material having strength higher than a resin material used for forming the throttle body.

2. The throttle apparatus according to claim 1, further comprising:

a transmitting device connected to the electric driving device, said transmitting device transmitting a driving force from the electric driving device to the valve member; and a supporting member fixed to the holding member, said supporting member rotatably supporting the transmitting device.

3. The throttle apparatus according to claim 1, wherein the holding member houses the electric driving device.

4. The throttle apparatus according to claim 1, wherein an inner wall of the air path near the valve member is formed by the holding member.

5. The throttle apparatus according to claim 1, wherein said holding member is made from magnesium.

6. The throttle apparatus according to claim 1, wherein said holding member is made of metal.

7. A throttle apparatus for adjusting an air flow rate through an air path formed in an internal combustion engine, said throttle apparatus comprising:

a resin throttle body material and having an air path formed therein;

a valve member provided in the throttle body so as to control an opening angle of the air path;

an electric driving device housed in the throttle body, said electric driving device generating a driving force that drives the valve member;

a transmitting device connected to the electric driving device, said transmitting device transmitting the driving force from the electric driving device to the valve member;

a supporting member that rotatably supports the transmitting device; and a holding member provided in the throttle body that affixes the supporting member and holds the electric driving device, said holding member being made of a material having strength higher than a resin material used for forming the throttle body.

8. The throttle apparatus according to claim 7, wherein the holding member houses the electric driving device.

9. The throttle apparatus according to claim 7, wherein said holding member is made of metal.

10. The throttle apparatus according to claim 7, wherein said holding member is made of magnesium.

11. A retaining member for retaining a position between elements of a throttle body, comprising:

a plate made of a material, wherein said plate has:

a first bore having a diameter sized to support a throttle shaft of a throttle valve;

a second bore having a diameter sized to support an electric driving device, a centerline of said second bore being positioned a predetermined distance from a centerline of said first bore; and an outer periphery of said plate sized to fit within a recess of a resin throttle body, said material having a strength higher than that of said resin throttle body.

12. The retaining member as claimed in claim 11, further comprising a transmission device, said transmission device supported by a third aperture in said plate, wherein a centerline of said third aperture is positioned a predetermined distance from said first aperture and said second aperture.

13. A retaining member for retaining a position between a throttle shaft, electric driving device, and a transmitting device of a resin throttle body, said retaining member comprising:

a plate made of a material having:

a first bore with a diameter sized to support a bearing, said bearing having a diameter sized to support a throttle shaft of a throttle valve;

a second bore having a diameter sized to support an electric driving device;

a third bore having a diameter sized to support a transmission member;

wherein centerlines of said first bore, said second bore and said third bore are positioned in said plate at predetermined distances from each other; and whereby said throttle shaft, said electric driving device and said transmission member are maintained at a predetermined relationship with each other when said plate is assembled in said resin throttle body;

an outer periphery of said plate that fits within a recess of said resin throttle body, said material having a strength higher than that of said resin throttle body.

* * * * *

UNITED STATES PATENT AND TRADEMARK OFFICE

CERTIFICATE OF CORRECTION

PATENT NO. : 6,295,968 B2
DATED : October 2, 2001
INVENTOR(S) : Torii et al.

It is certified that error appears in the above-identified patent and that said Letters Patent is hereby corrected as shown below:

Title page,
Item [30], change "12-039709" to -- 2000-039709 --; and change "13-009000" to -- 2001-009000 --.

Signed and Sealed this

Twenty-first Day of May, 2002

*Attest:*

*Attesting Officer*

JAMES E. ROGAN
*Director of the United States Patent and Trademark Office*